United States Patent [19]

Makimoto et al.

[11] 4,268,809

[45] May 19, 1981

[54] MICROWAVE FILTER HAVING MEANS FOR CAPACITIVE INTERSTAGE COUPLING BETWEEN TRANSMISSION LINES

[75] Inventors: Mitsuo Makimoto; Sadahiko Yamashita, both of Kawasaki, Japan

[73] Assignee: Matsushita Electric Industrial Co., Ltd., Osaka, Japan

[21] Appl. No.: 71,492

[22] Filed: Aug. 31, 1979

[30] Foreign Application Priority Data

Sep. 4, 1978 [JP] Japan ..... 53-109003

[51] Int. Cl.[3] ..... H01P 1/201; H01P 7/02

[52] U.S. Cl. ..... 333/202; 333/207; 333/223; 333/224

[58] Field of Search ..... 333/202–207, 333/219–231

[56] References Cited

U.S. PATENT DOCUMENTS 3,273,083 9/1966 Rose ..... 333/227 X 4,151,494 4/1979 Nishikawa et al. ..... 333/204

*Primary Examiner*—Marvin L. Nussbaum

*Attorney, Agent, or Firm*—Lowe, King, Price & Becker

[57] ABSTRACT

A microwave filter comprising within a conductive casing, a plurality of resonant transmission lines arranged parallel between opposed end walls of the casing, a plurality of shielding members each located between adjacent transmission lines, and a capacitive interstage coupling member disposed transverse to the transmission line. The interstage coupling member comprises a dielectric member and a plurality of conductive regions arranged successively thereon so as to establish capacitive coupling between adjacent conductive regions. Each transmission line is connected at one end to a side wall of the casing and supported at the other end by the dielectric member in electrical contact with a respective one of the conductive regions, whereby the interstage coupling between the transmission lines is provided by the capacitively coupled conductive regions.

17 Claims, 8 Drawing Figures

MICROWAVE FILTER HAVING MEANS FOR CAPACITIVE INTERSTAGE COUPLING BETWEEN TRANSMISSION LINES

BACKGROUND OF THE INVENTION

The present invention relates to a microwave filter which is particularly suitable for automotive radio communications.

Conventional microwave filter comprises a conductive casing and a plurality of parallel transmission lines each acting as a resonator tuned to a specific frequency in the microwave region. The bandwidth of the filter is determined by the amount of interstage coupling between adjacent transmission lines. For microwave filters in which microwave energy distributed along one transmission line is directly coupled to another through the space between them, the bandwidth is inversely proportional to the spacing between transmission lines. This results in microwave filters having different overall dimensions depending on the different bandwith requirements and is thus disadvantageous for mass production.

Another microwave filter design involves the use of a plurality of shielding members each located between adjacent transmission lines and provided with an opening through which the microwave energy of one transmission line is coupled to another. Although the latter results in microwave filters having a uniform overall size, this involves complicated design procedures.

SUMMARY OF THE INVENTION

Accordingly, an object of the present invention is to provide microwave filters of different bandwidths in a uniform filter casing without entailing a complicated design procedure.

This object is achieved by the provision of a capacitive interstage coupling member which comprises a dielectric member extending transverse to the transmission lines and a plurality of conductive plates mounted thereon. Each transmission line has its one end connected to a side wall of the casing and has its other end supported by the dielectric member in electrical contact with respective conductive plates. The conductive plates are so arranged on the dielectric member as to form a capacitive coupling between adjacent plates. Between adjacent transmission lines is located a shielding member for purposes of preventing the direct coupling of microwave energy from one transmission line to another so that the capacitive coupling member serves as a sole interstage coupling path between adjacent transmission lines. The amount of interstage coupling can thus be easily determined by simply dimensioning the conductive plates to meet the specific bandwidth requirements of a particular filter. Since the transmission lines are supported at opposite ends thereof, the microwave filter of the invention is immune to mechanical impact which is particularly important to automotive applications. Because of the planar structure of the conductive plates and the dielectric member, the capacitive interstage coupling member can be formed as a one-piece construction which is suitable for mass production, so that a desired bandwidth is realized by a mere selection of a desired interstage coupling member and mounting it in a casing of a size which is equal for all microwave filters.

The capacitive interstage coupling member also serves as a means for injecting microwave energy into the filter casing by coupling an input terminal to one end thereof and as a means for extracting output microwave energy by coupling the opposite end thereof to an output terminal. This also simplifies the filter design and manufacture.

BRIEF DESCRIPTION OF THE DRAWINGS

The invention will be further described by way of example with reference to the drawings, in which.

DETAILED DESCRIPTION

Figure 1:
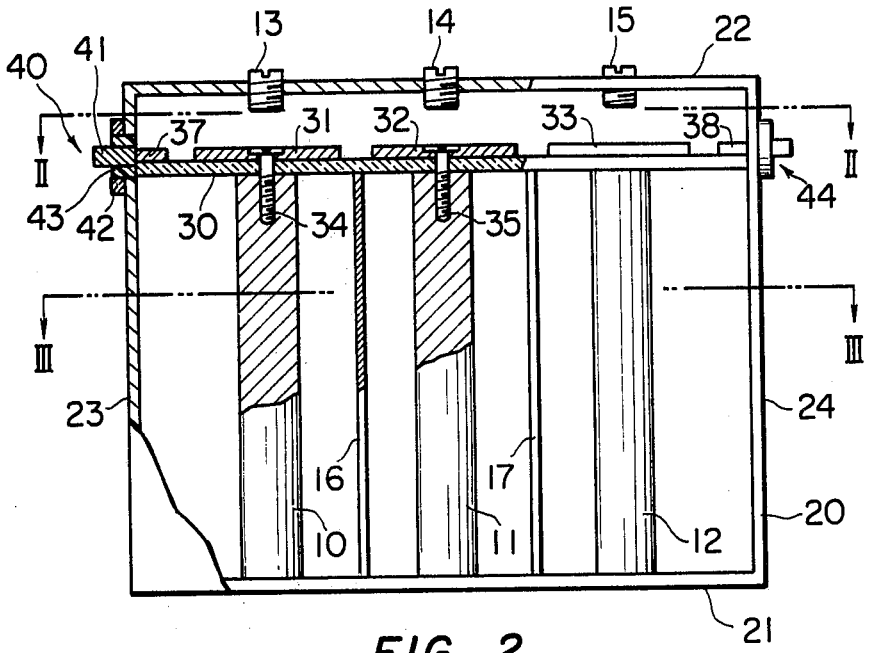
FIG. 1 is a partially broken cutaway plan view of a microwave bandpass filter of the invention.
Figure 3:
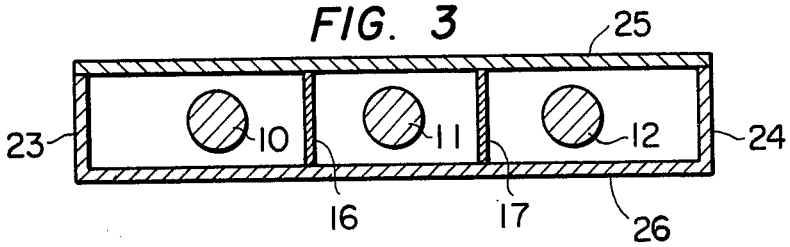
FIG. 3 is a cross-sectional view taken along the lines 3—3 of FIG. 1.

A microwave bandpass filter of the invention, as represented in FIG. 1, comprises a plurality of equally spaced-apart parallel transmission lines 10, 11 and 12 in the form of cylindrical conductors. The number and physical dimensions and shape of the transmission lines of this embodiment are for the purpose of illustration, and not limited to those shown in FIG. 1. The conductors serving as the transmission lines 10 to 12 have their one ends connected to and supported by the side wall 21 of a conductive casing 20 and extend toward the opposite side wall 22 in parallel spaced relation with the end walls 23 and 24 and the top and bottom walls 25 and 26 of the casing, as best shown in FIG. 3. Adjustable screws 13, 14 and 15 are threaded through the side wall 22 into the casing to form variable capacitance elements with the other ends of the transmission lines 10, 11 and 12, respectively. The other end of each transmission line conductor is supported by an elongated dielectric member 30 which extends between the end walls 23 and 24 in parallel with the side wall 22.

Figure 2:
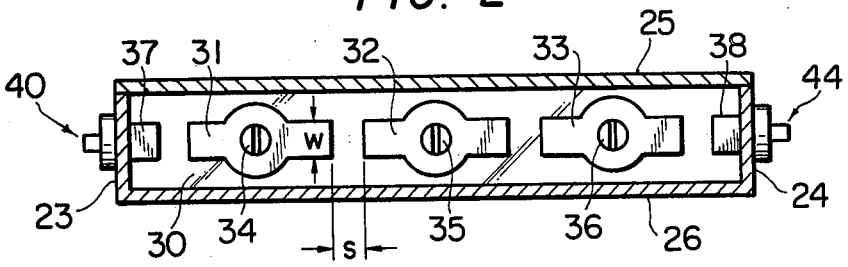
FIG. 2 is a cross-sectional view taken along the lines 2—2 of FIG. 1.

On the surface of the dielectric support 30 remote from the transmission conductors 10 to 12 are provided metal planar members 31, 32 and 33 which are secured thereto and further electrically connected to the transmission lines 10 to 12 by means of screws 34, 35 and 36, respectively, as best shown in FIG. 2. On the dielectric support 30 is also provided an input conductive planar member 37 which is electrically connected to an inner conductor 41 of an input terminal 40 of which the outer conductor 42 is connected to the end wall 23 of the casing and electrically isolated by an insulator 43. Similarly, adjacent to the metal plate 33 is provided an output conductive planar member 38 which is connected to an output terminal 44 in the same fashion as the input terminal 40.

The conductive members 31 to 33 constitute a capacitive transmission path which serves as an interstage coupling between adjacent transmission lines. The conductive members 37 and 31 serve as a microwave injection capacitive coupling means and the conductive members 33 and 38 serve as a capacitive coupling means for extracting the tuned microwave energy.

Figure 4:
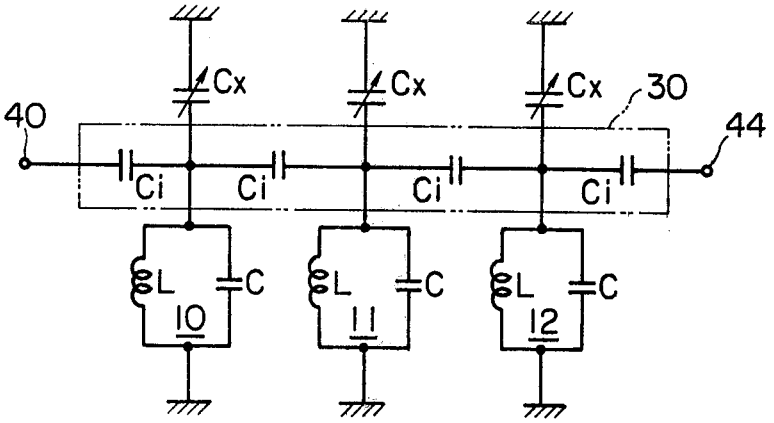
FIG. 4 is an equivalent electrical circuit of the bandpass filter of FIG. 1.

As illustrated in FIG. 4, the conductive planar members successively arranged on the dielectric support 30 are shown in an equivalent circuit configuration as comprising interstage coupling capacitors $C_i$ which are connected in series between the input and output terminals 40 and 44. The capacitance values of these equivalent capacitors are determined by the width W of each adjoining conductive members and the spacing S between the adjacent edges of the conductive members as shown in FIG. 2. Each transmission line is represented by a parallel LC circuit and each adjustable capacitance is represented by capacitor Cx which is connected in series with the associated LC circuit between ground terminals, the junction therebetween being connected to the junction between the associated capacitors on the dielectric support represented by a broken line 30.

In each of the transmission line there is a distribution of microwave energy coupled through the transversely connected capacitors on the dielectric support 30. To prevent the distributed microwave energy from directly coupling with the adjacent transmission line, shielding members 16 and 17 are provided which extend between the side wall 21 and the dielectric support 30.

For microwave filters of a relatively wide passband characteristic the width W and spacing S are so dimensioned as to provide a relatively large amount of capacitive coupling between adjacent transmission lines, and filters of a relatively narrow passband characteristic can be designed by decreasing the aforesaid factors to provide a relatively small capacitive coupling. Therefore, the bandwidth of a microwave filter can be designed without altering the spacing between adjacent transmission lines. This is particularly advantageous to mass produce microwave filters of different passband characteristics since the latter can be simply achieved by different structural designs of the conductive members on the dielectric support which are pre-cut from a single metal sheet or formed on the support by vacuum deposition through a mask of a predetermined pattern.

Since the transmission line conductors are supported at both ends by a rigid structure, the microwave filter of the invention is capable of withstanding mechanical shocks. This vibration free characteristic renders the filter of the invention suitable to be mounted on automobiles for radio communications.

Figure 5:
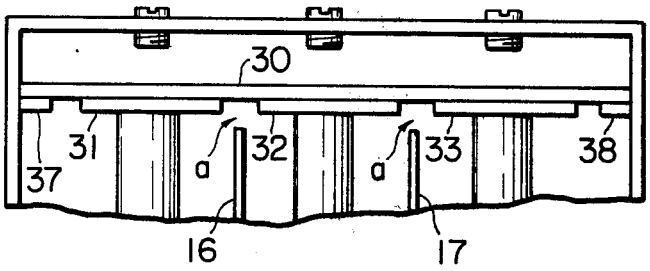
FIG. 5 is a view showing a modified form of the embodiment of FIG. 1.

The interstage conductive coupling elements 31–33, 37 and 38 can also be arranged on the surface of the dielectric support 30 adjacent to the transmission lines 10–12 as illustrated in FIG. 5. In this modification, the shielding plates 16 and 17 terminate a distance from the dielectric support 30 to provide an air gap a to allow capacitive interstage coupling between adjacent conductive members on the dielectric support 30.

Figure 6:
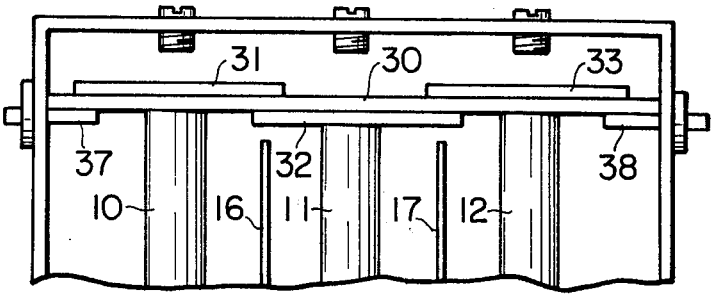
FIG. 6 is a view showing another modification of the embodiment of FIG. 1.

A greater amount of interstage coupling can be achieved by modifying the previous embodiments as illustrated in FIG. 6. This modification is useful for a wide bandwidth filter design. In FIG. 6, the interstage coupling members are provided on opposite surfaces of the dielectric support 30 in a staggered and partially overlapping relation with adjacent members, so that a greater value of capacitance is provided between the overlapped areas. The shielding plates 16 and 17 terminate a distance from the coupling member 32 to prevent the latter from making an electrical contact with the shielding plates.

Figure 7:
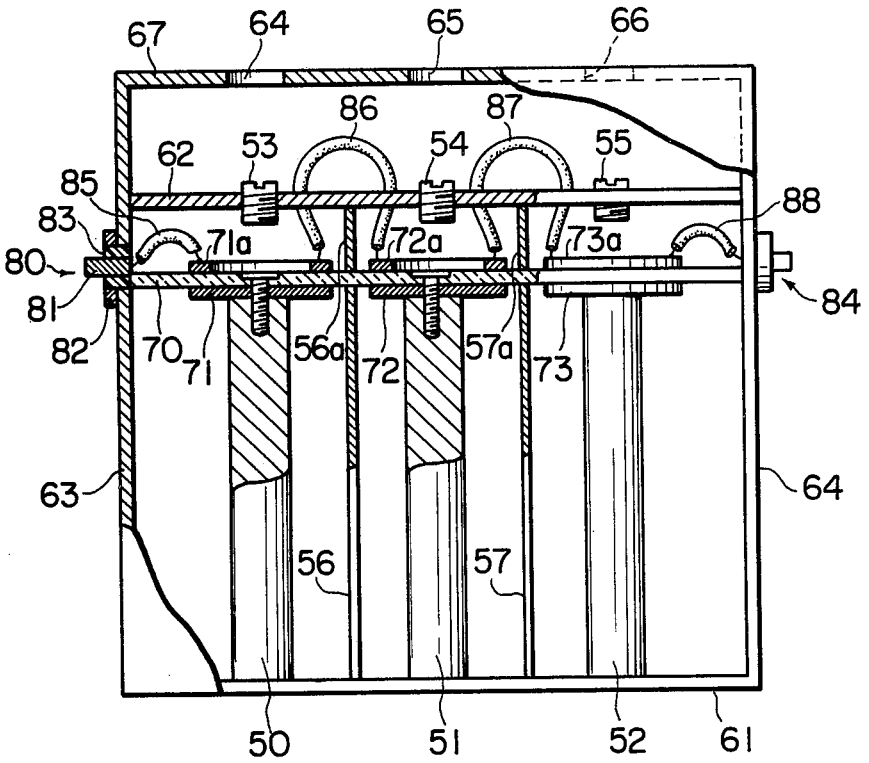
FIG. 7 is a partially broken cutaway plan view of a microwave notch filter of the invention.

FIG. 7 is an illustration of a microwave notch filter of the invention. In the illustrated notch filter the interstage coupling is accomplished by a plurality of coupling capacitors and quarter-wavelength lines connected between adjacent coupling capacitors. Specifically, the notch filter is basically of the same construction as in the previous embodiments with the exception that each coupling capacitor is formed between a disc-shaped conductive member 71 (72, 73) electrically and coaxially connected to the transmission line 50 (51, 52) and an annular conductive member 71*a* (72*a*, 73*a*) disposed on the opposite face of the dielectric support 70. The annular conductive member 71*a* is connected by a conductor 85 to the inner conductor 81 of the input terminal 80 of which the outer conductor 82 is connected to the end wall 63 and isolated from the inner conductor by an insulator 83 and allows capacitive coupling between tuning screws 53–55 and transmission lines 50–52. The conductive members 71*a* and 72*a* are connected together by a quarter-wavelength line 86 and the conductive members 72*a* and 73*a* are connected together by another quarter-wavelength line 87, the latter member 73*a* being further connected by a conductor 88 to the inner conductor of the output terminal 84.

Figure 8:
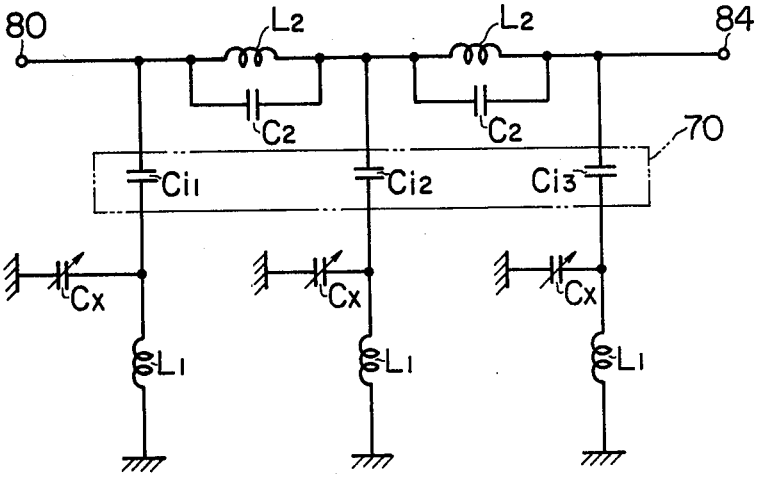
FIG. 8 is an equivalent electrical circuit of the embodiment of FIG. 7.

The operation of the notch filter can be visualized with reference to the equivalent circuit thereof shown in FIG. 8. Each transmission line is represented by an inductive circuit $L_1$ which is coupled to the tuning capacitor Cx provided by a respective one of adjustable screws 53, 54 and 55 threaded through an inner side wall 62 of the casing. The junction between each inductive circuit $L_1$ and each tuning capacitor Cx is connected to the junction of adjacent inductive circuit $L_1$ and its associated tuning capacitor Cx by means of a series circuit including two interstage coupling capacitors $C_{ij}$ and a parallel resonance circuit $L_2$, $C_2$, the latter representing each quarter-wavelength line. The input microwave energy is applied to the input terminal 80 and coupled to the first transmission line 50 through the coupling capacitor $C_{i1}$. The microwave energy injected into the first transmission line 50 is then coupled to the next stage 52 through the coupling capacitor $C_{i1}$, quarter-wavelength circuit $L_2$, $C_2$ and coupling capacitor $C_{i2}$, and then finally extracted from the output terminal 84 through the coupling capacitor $C_{i3}$ formed by the conductive elements 73 and 73*a* of the third transmission line 53.

Shielding plates 56 and 57 are provided between the transmission lines 50, 51 and 52 and secured at one end to a side wall 61 and at the other end to the dielectric support 70 for purposes of isolating the transmission lines from each other as in the previous embodiments. Further shielding members 56*a* and 57*a* are provided for preventing direct interstage coupling between adjacent capacitive members which bypasses the quarter-wavelength lines.

The end walls 63 and 64 of the casing extend beyond the inner side wall 62 to secure an outer side wall 67 through which small access openings 64, 65 and 66 are provided to allow adjustment of the tuning screws 53 to 55. The outer side wall 67 serves to confine the microwave energy emanating from the quarter-wavelength lines 86 and 87 within the casing.

What is claimed is:

1. A microwave filter having a conductive casing with top and bottom walls and opposed pairs of side and end walls, comprising within said casing:

a dielectric member extending parallel with said side walls;

a plurality of conductive regions arranged on said dielectric member so that each conductive region is capacitively coupled with an adjacent conductive region;

a plurality of parallel transmission lines successively arranged between said end walls and spaced from said top and bottom walls, each being electrically connected at one end to one of said walls and supported at the other end by said dielectric member in electrical contact with a respective one of said conductive regions;

means for injecting microwave energy through one of said end walls and withdrawing microwave energy through the other end wall; and a plurality of shielding members each being disposed between adjacent ones of said transmission lines to prevent microwave energy propagating along each of said transmission lines from coupling with an adjacent transmission line.

2. A microwave filter as claimed in claim 1, wherein said conductive regions are successively arranged on one surface of said dielectric member.

3. A microwave filter as claimed in claim 1, wherein said conductive regions are arranged alternately on opposite surfaces of said dielectric member in a staggered, partially overlapping relation with one another.

4. A microwave filter as claimed in claim 1, 2 or 3, wherein said microwave injecting means comprises an input terminal adapted to receive microwave energy and a conductive region electrically in contact with said input terminal and disposed on said dielectric member to capacitively couple with the one of said conductive regions which is electrically in contact with the transmission line adjacent to said one end wall, and wherein said microwave withdrawing means comprises an output terminal and a conductive region electrically in contact with said output terminal and disposed on said dielectric member to capacitively couple with the one of said conductive regions which is electrically in contact with the transmission line adjacent to the other end wall.

5. A microwave filter as claimed in claim 4, further comprising a plurality of adjustable capacitance elements associated respectively with said transmission lines.

6. A microwave filter as claimed in claim 5, wherein each of said adjustable capacitance elements comprises an adjustable screw threaded through the other side wall of said casing and positionally associated with a respective one of said transmission lines.

7. A microwave filter as claimed in claim 1, wherein each of said transmission lines comprises a cylindrical conductive member extending parallel with said end walls and supported at one end by one of said side walls and supported at the other end by said dielectric member.

8. A microwave bandpass filter having a conductive casing with top and bottom walls and opposed pairs of side and end walls, comprising within said casing:

a dielectric member extending parallel with said side wals;

a plurality of successively arranged, capacitively coupled conductive regions on said dielectric member;

a plurality of parallel transmission lines successively arranged between said end walls and spaced from said top and bottom walls, each being electrically connected at one end to one of said side walls and supported at the other end by said dielectric member in electrical contact with a respective one of said conductive regions;

means for injecting microwave energy through one of said end walls and withdrawing microwave energy through the other end wall; and a plurality of shielding members each being disposed between adjacent ones of said transmission lines to prevent microwave energy propagating along each of said transmission lines from coupling with an adjacent transmission line.

9. A microwave bandpass filter as claimed in claim 8, wherein said conductive regions are arranged on one surface of said dielectric member.

10. A microwave bandpass filter as claimed in claim 8, wherein said conductive regions are arranged alternately on opposite surfaces of said dielectric member in a staggered, partially overlapping relation with one another.

11. A microwave bandpass filter as claimed in claim 8, 9 or 10, wherein said microwave injecting means comprises an input terminal adapted to receive microwave energy and a conductive region electrically in contact with said input terminal and disposed on said dielectric member to capacitively couple with the one of said conductive regions which is electrically in contact with the transmission line adjacent to said one end wall, and wherein said microwave withdrawing means comprises an output terminal and a conductive region electrically in contact with said output terminal and disposed on said dielectric member to capacitively couple with the one of said conductive regions which is electrically in contact with the transmission line adjacent to the other end wall.

12. A microwave bandpass filter as claimed in claim 11, further comprising a plurality of adjustable capacitance elements associated respectively with said transmission lines.

13. A microwave bandpass filter as claimed in claim 12, wherein each of said adjustable capacitance elements comprises an adjustable screw threaded through the other side wall of said casing and positionally associated with a respective one of said transmission lines.

14. A microwave bandpass filter as claimed in claim 8, wherein each of said transmission lines comprises a cylindrical conductive member extending parallel with said end walls and supported at one end by one of said side walls and supported at the other end by said dielectric member.

15. A microwave notch filter having a conductive casing with top and bottom walls and opposed pairs of side and end walls, comprising within said casing:

a dielectric member extending parallel with said side walls;

a plurality of capacitive elements successively arranged on said dielectric member;

a plurality of parallel transmission lines successively arranged between said end walls and spaced from said top and bottom walls, each being electrically connected at one end to one of said side walls and supported at the other end by said dielectric member in electrical contact with a respective one of said capacitive element;

a plurality of quarter-wavelength lines each connected between adjacent ones of said capacitive elements;

an input terminal mounted on one of said end walls in electrical contact with the one of said capacitive elements which is adjacent to said one end wall for receiving microwave energy;

an output terminal mounted on the other end wall in electrical contact with the one of said capacitive elements which is adjacent to said other end wall; and a plurality of shielding members each being disposed between adjacent ones of said transmission lines to prevent microwave energy propagating along each of said transmission lines from coupling with an adjacent transmission line.

16. A microwave notch filter as claimed in claim 15, wherein each of said capacitive elements comprises a conductive circular planar member attached to one surface of said dielectric member in electrical contact with one end of the associated transmission line and in a coaxial relation therewith and an annular conductive member attached to the other surface of said dielectric member in opposed relation with said circular planar member to form a capacitance therewith, the annular conductive members associated with adjacent transmission lines being connected via said quarter-wavelength line, further comprising a plurality of adjustable capacitances each being formed between the other side wall of the casing and said one end of a respective one of said transmission lines through the opening of the associated annular conductive member.

17. A microwave notch filter as claimed in claim 16, wherein each of said adjustable capacitances comprises an adjustable screw threaded through said other side wall of the casing and positionally associated with a respective one of said transmission line through the opening of said associated annular conductive member.

* * * * *